US007823755B2

(12) United States Patent
Park et al.

(10) Patent No.: US 7,823,755 B2
(45) Date of Patent: Nov. 2, 2010

(54) REFRIGERATOR AND DUCT CAP ASSEMBLY THEREFOR

(75) Inventors: Kyong Bae Park, Seoul (KR); Sung Jhee, Seoul (KR); Nam Soo Cho, Seoul (KR)

(73) Assignee: LG Electronics Inc., Seoul (KR)

( * ) Notice: Subject to any disclaimer, the term of this patent is extended or adjusted under 35 U.S.C. 154(b) by 581 days.

(21) Appl. No.: 11/839,052

(22) Filed: Aug. 15, 2007

(65) Prior Publication Data

US 2008/0053133 A1 Mar. 6, 2008

(30) Foreign Application Priority Data

Aug. 30, 2006 (KR) ..... 10-2006-0082824

(51) Int. Cl.
*B65D 47/00* (2006.01)

(52) U.S. Cl. ..... 222/477; 222/146.6

(58) Field of Classification Search ..... 222/477, 222/146.6; 221/15; 62/344, 266; 188/286–288, 188/322.16–322.22
See application file for complete search history.

(56) References Cited

U.S. PATENT DOCUMENTS

| | | | | |
|---|---|---|---|---|
| 3,537,132 | A | 11/1970 | Alvarez | 62/266 |
| 3,572,053 | A | 3/1971 | Jacobus et al. | 62/344 |
| 4,462,437 | A | 7/1984 | Prada | 141/360 |
| 4,945,103 | A | 7/1990 | Cohen | 514/419 |
| 5,456,131 | A * | 10/1995 | Nakamura et al. | 74/473.21 |
| 5,526,854 | A * | 6/1996 | Unger | 141/351 |
| 5,884,734 | A | 3/1999 | Hiramoto et al. | 188/322.18 |
| 6,135,173 | A * | 10/2000 | Lee et al. | 141/361 |
| 6,176,475 | B1 * | 1/2001 | Bella et al. | 267/120 |
| 6,460,839 | B2 | 10/2002 | Muller | 267/221 |
| 7,325,408 | B2 * | 2/2008 | Lim | 62/66 |
| 7,437,885 | B2 * | 10/2008 | Wu et al. | 62/344 |
| 7,445,137 | B2 * | 11/2008 | Noh et al. | 222/477 |
| 2004/0211631 | A1 | 10/2004 | Hsu | 168/284 |

FOREIGN PATENT DOCUMENTS

| | | |
|---|---|---|
| CN | 1793762 | 6/2006 |

(Continued)

OTHER PUBLICATIONS

Office Action dated Jul. 22, 2009 for U.S. Appl. No. 11/838,971.

(Continued)

*Primary Examiner*—Lien T Ngo
(74) *Attorney, Agent, or Firm*—KED & Associates, LLP

(57) ABSTRACT

A refrigerator is provided which includes a duct cap disposed so as to open and close an ice duct formed in the refrigerator, an opening and closing device connected so as to open and close the duct cap, and a damper connected to one of the duct cap and the opening and closing device such that a closing operation of the duct cap is delayed. The opening and closing device allows the duct cap to be manually opened and closed, and the damper is interlocked with the opening and closing device so as to delay a closing operation of the duct cap. With this structure, cost may be reduced and noise and/or vibration minimized, compared with mechanisms with the closing operation of the duct cap delayed using electric driving parts, such as solenoids.

24 Claims, 8 Drawing Sheets

FOREIGN PATENT DOCUMENTS

| | | | | |
|---|---|---|---|---|
| JP | 54-384575 | * | 3/1979 | ..... 267/120 |
| KR | 1999/0025277 | | 7/1999 | |
| KR | 1999/0031596 | | 7/1999 | |
| KR | 10/0286034 | | 1/2001 | |
| KR | 10/0286037 | | 1/2001 | |

OTHER PUBLICATIONS

Chinese Office Action dated Aug. 8, 2008.
U.S. Office Action dated Jan. 11, 2010.

* cited by examiner

REFRIGERATOR AND DUCT CAP ASSEMBLY THEREFOR

This Nonprovisional application claims priority under 35 U.S.C. §119(a) to Korean Patent Application No. 10-2006-0082824 filed in Korea on Aug. 30, 2006, the entire contents of which are hereby incorporated by reference.

BACKGROUND

1. Field

A refrigerator and duct cap assembly therefor are disclosed herein.

2. Description of the Related Art

Refrigerators serve to maintain a freezer compartment and a refrigerating compartment room at low temperatures using a refrigerating cycle apparatus. The refrigerating cycle apparatus including a compressor, a condenser, an expander, and an evaporator. The refrigerators often have automatic ice machines mounted therein, which utilize cold air in the freezer compartment to make ice. However, related art refrigerators with automatic ice makers have various disadvantages.

BRIEF DESCRIPTION OF THE DRAWING

Embodiments will be described in detail with reference to the following drawings, in which like reference numerals refer to like elements, and wherein.

DETAILED DESCRIPTION OF THE PREFERRED EMBODIMENT

Reference will now be made in detail to specific embodiments, examples of which are illustrated in the accompanying drawings. A refrigerator and duct cap assembly therefor according to embodiments are disclosed herein. The duct cap assembly according to embodiments is disclosed as implement in a refrigerator, as an example. However, the duct cap assembly according to embodiments may also be implemented in other types of apparatus as well.

Figure 1:
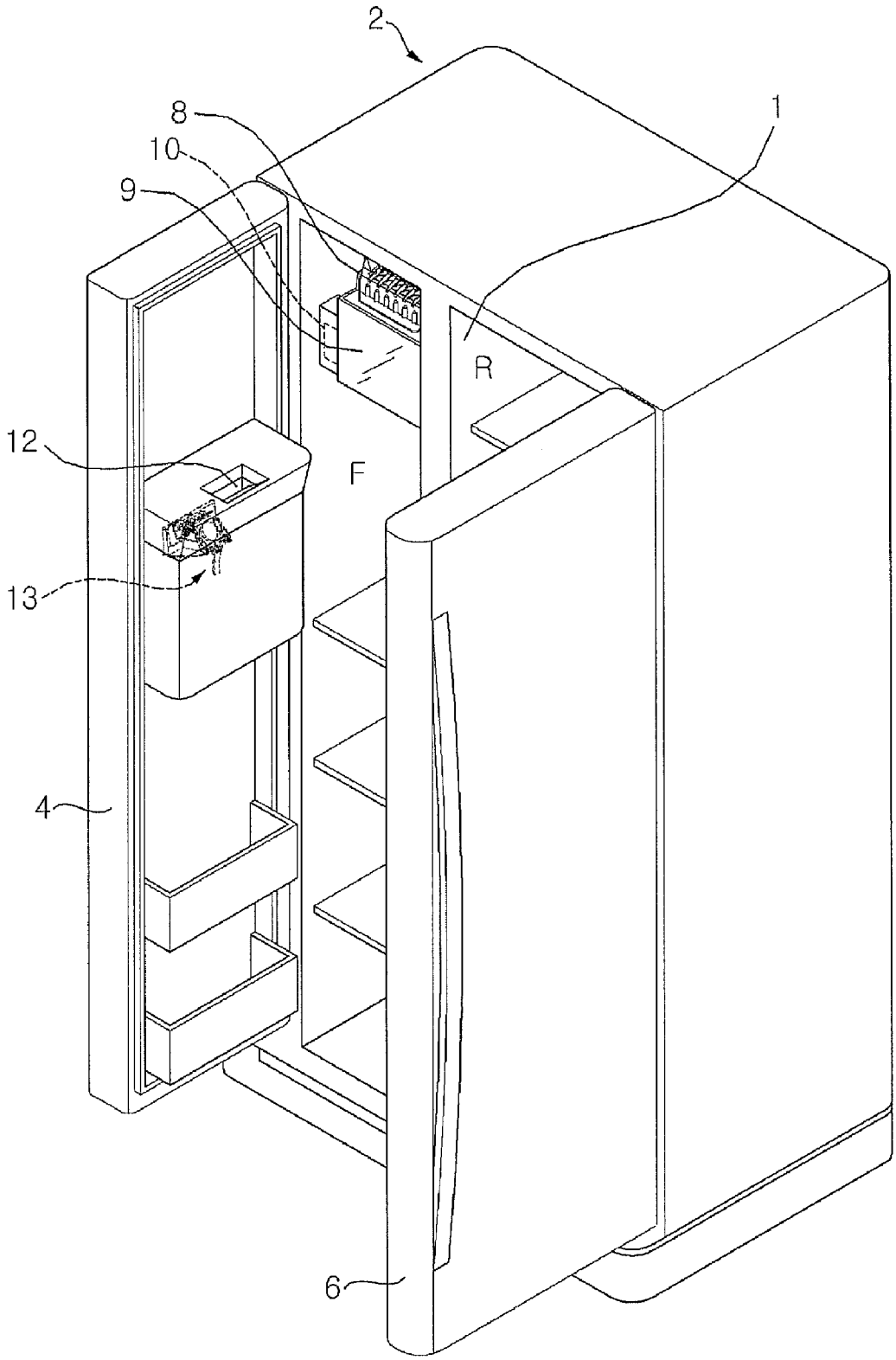
FIG. 1 is a perspective view of a refrigerator according to an embodiment, showing a state in which the freezer and refrigerating compartment are open.

FIG. 1 is a perspective view of a refrigerator showing a state in which a freezer and refrigerator compartment are open. As shown in FIG. 1, the refrigerator includes a main body 2 having a freezer compartment F and a refrigerating compartment R divided by a barrier; a freezer door 4 connected to the main body 2 so as to open and close the freezer compartment F; and a refrigerator door 6 connected to the main body 2 so as to open and close the refrigerating compartment R. The refrigerator also includes a refrigerating cycle apparatus (not shown) mounted to refrigerate the freezer compartment F and the refrigerating compartment R at low temperatures.

The refrigerating cycle apparatus may include a compressor that compresses a low-temperature and low-pressure gas refrigerant, a condenser in which the high-temperature and high-pressure refrigerant compressed by the compressor is radiated into external air such that the refrigerant is condensed, an expander that decompresses the refrigerant condensed by the condenser, and an evaporator in which the refrigerant expanded by the expander to take the heat of air circulating from the freezer compartment F or the refrigerating compartment R so as to be evaporated.

Recently, refrigerators have included automatic ice makers or machines mounted therein. The automatic ice machine makes ice using cool air within the freezer compartment F and automatically discharges the ice outside the refrigerator in accordance with an operation of a user.

The automatic ice machine may include an ice maker 8 which converts water into ice using cool air within the freezer compartment F and an ice bank 9 which deices and stores the ice made by the ice maker 8. The ice bank 9 may include a transferring body which transfers the ice put into the ice bank 9 such that the ice is discharged, and a motor 10 which rotates the transferring body.

The freezer door 4 has a dispenser (not shown) installed therein which discharges the ice transferred from the ice bank 9 and water fed from a water feeder (not shown) outside of the refrigerator. Further, the freezer door 4 may include an ice duct 12 that serves as a path which guides the ice transferred from the ice bank 9 to the dispenser, and an ice duct opening and closing device 13 that opens and closes the ice duct 12.

Figure 2:
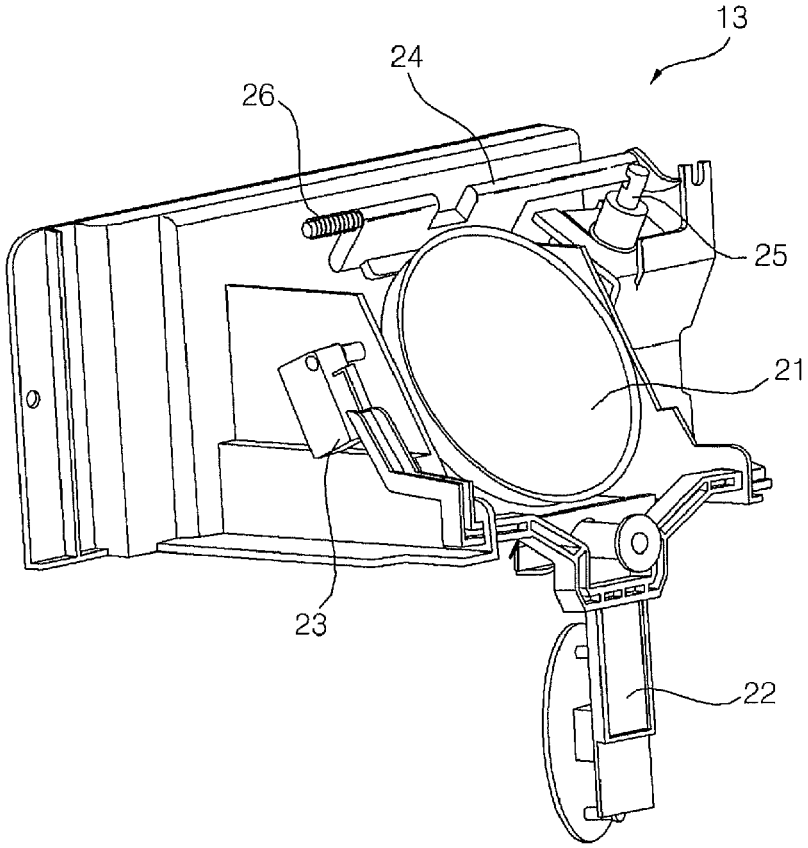
FIG. 2 is a perspective view of an ice duct opening and closing device of the refrigerator of FIG. 1.
Figure 3:
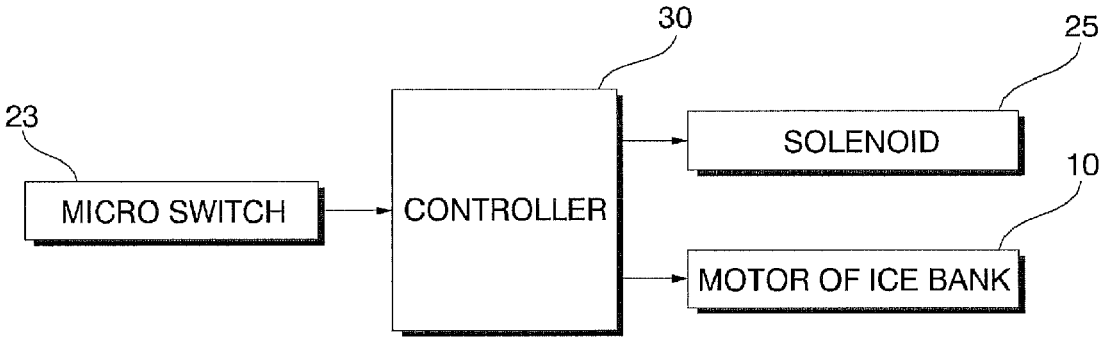
FIG. 3 is a control block diagram of an automatic ice machine of the refrigerator of FIG. 1.

FIG. 2 is a perspective view of the ice duct opening and closing device of the refrigerator of FIG. 1. FIG. 3 is a control block diagram of the automatic ice machine of the refrigerator of FIG. 1.

As shown in FIG. 2, the ice duct opening and closing device 13 may include a duct cap 21 disposed to open and close the ice duct 12, a lever 22 configured to be manipulated by a user, a micro switch 23 turned on/off by the lever 22, a rotating shaft 24 configured to rotate the duct cap 21, a solenoid 25 configured to rotate the rotating shaft 24 to a position of opening the ice duct 12 and a position of closing the ice duct 12, and a spring 26 configured to elastically support the rotating shaft 24. The refrigerator may further include a controller 30 that operates the motor 10 of the ice bank 9 and the solenoid 25 in accordance with an input of the micro switch 23.

An ice discharge operation of a refrigerator having such a construction will be described as follows.

First, when a user presses the lever 22, that is, when a force is applied to the lever 22, the lever 22 operates the micro switch 23, that is, turns on the micro switch 23, and the controller 30 operates the solenoid 25 and the motor 10 of the ice bank 9. The solenoid 25 rotates the rotating shaft 24, and the duct cap 21, which closes the ice duct 12, is rotated with the rotating shaft 24 to open the ice duct 12.

When the motor 10 of the ice bank 9 is operated, the ice in the ice bank 9 is discharged from the ice bank 9 so that it falls into the ice duct 12. Then, the fallen ice is discharged into the dispenser through the opened ice duct 12.

Meanwhile, when the user releases the lever 22, that is, when the force applied to the lever 22 is removed, the lever 22 turns off the micro switch 23. The controller 30 does not return the solenoid 25 back to its original position immediately, but after a delay of a predetermined period of time, for example, four seconds, in order to discharge the remaining ice.

During the control operation of returning the solenoid 25 to its original position, the spring 26 rotates the rotating shaft 24, and the duct cap 21 is rotated to the ice duct closing position to close the ice duct 12. In this embodiment, however, the solenoid 25 is mounted so as to perform the closing operation after closing of the duct cap 21 is delayed for a predetermined period of time. The solenoid increases cost, and excessive noise occurs when the solenoid is operated.

Figure 4:
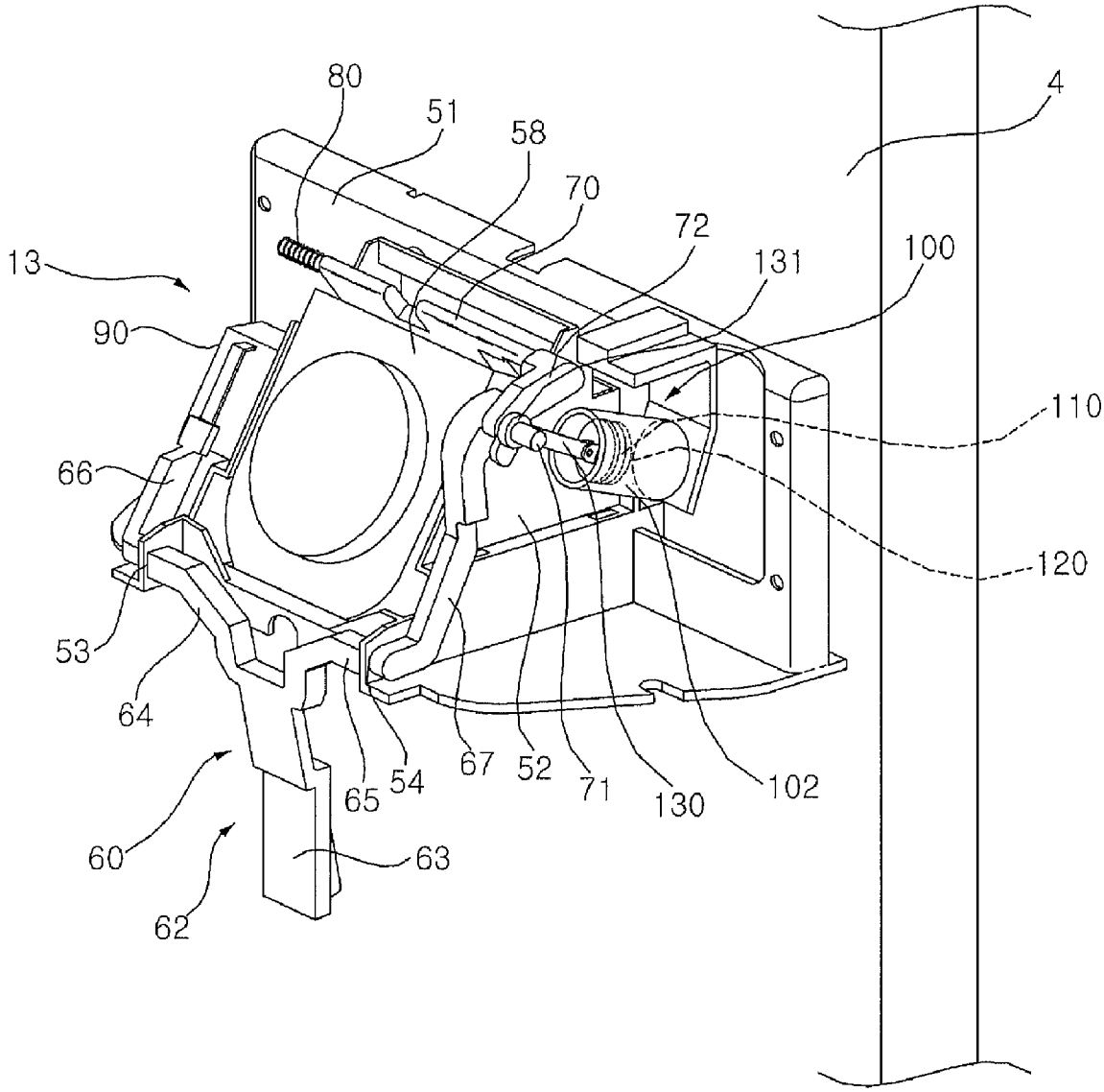
FIG. 4 is a perspective view of an ice duct opening and closing device according to another embodiment.
Figure 5:
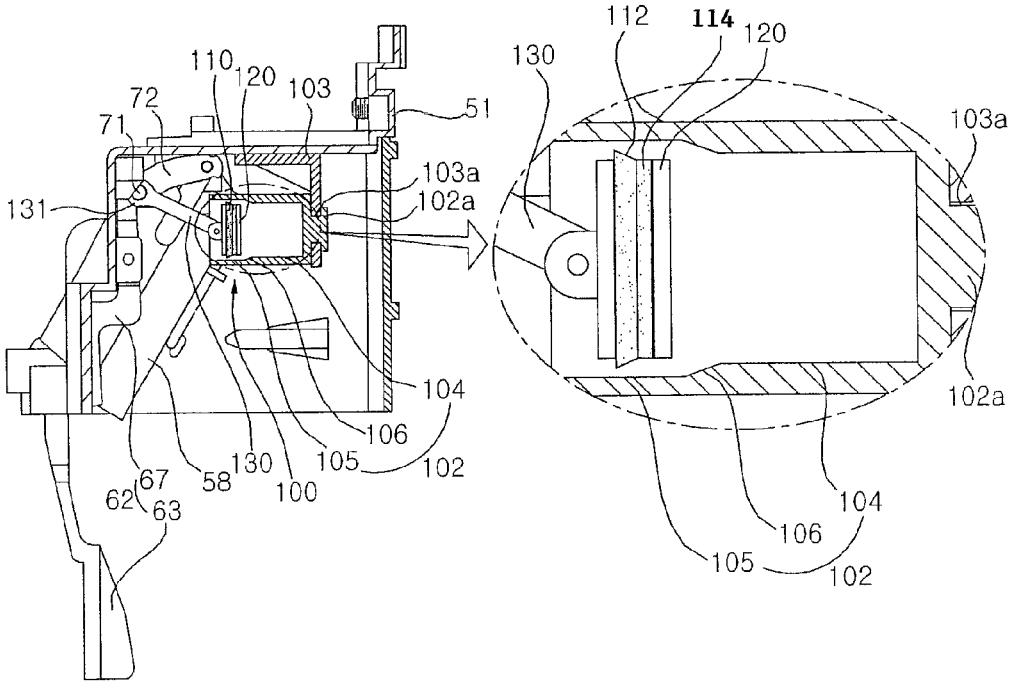
FIG. 5 is a partially cut-out side view of the ice duct opening and closing device of FIG. 4 in a closed state.
Figure 6:
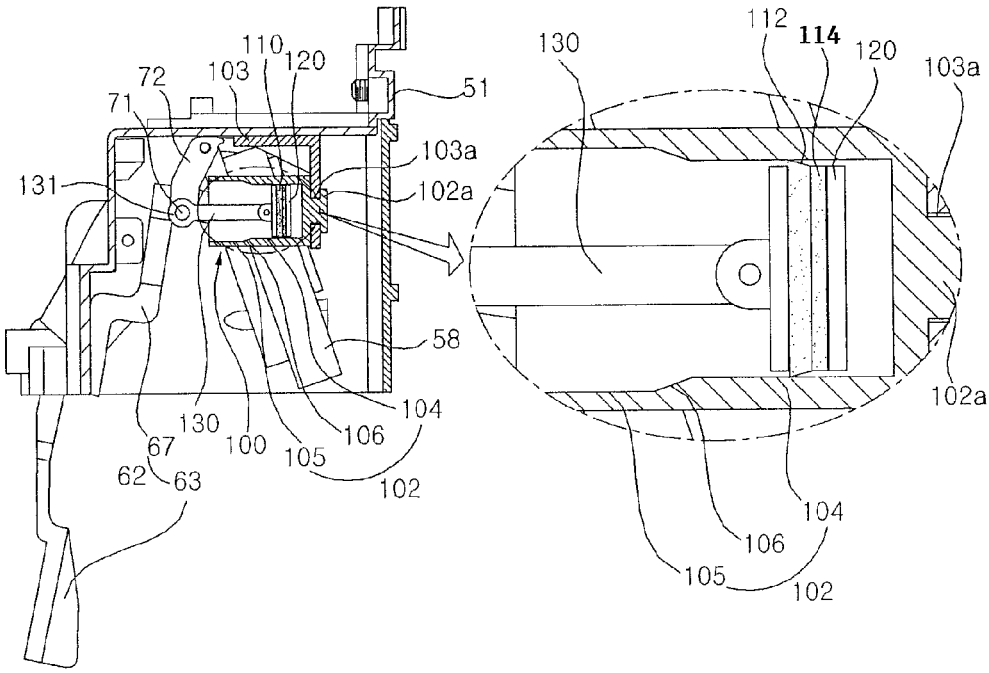
FIG. 6 is a partially cut-out side view of the ice duct opening and closing device of FIG. 4 in an open state.
Figure 7:
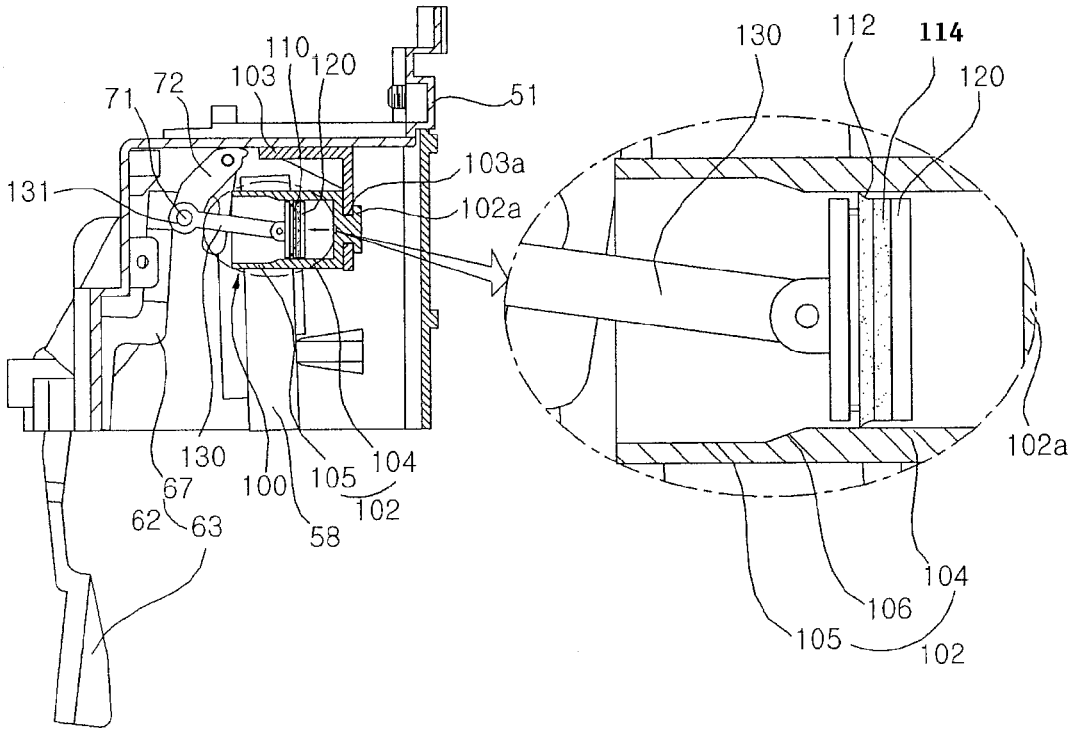
FIG. 7 is a partially cut-out side view of the ice duct opening and closing device of FIG. 4 in a closed state.

FIG. 4 is a perspective view illustrating an ice duct opening and closing device according to another embodiment. FIG. 5 is a partially cut-out side view of the ice duct opening and closing device of FIG. 4 in a closed state. FIG. 6 is a partially cut-out side view of the ice duct opening and closing device of FIG. 4 in an opened state. FIG. 7 is a partially cut-out side view of ice duct opening and closing device of FIG. 4 in a closed state.

The refrigerator according to this embodiment may include an ice duct closing and opening device 13 which opens and closes an ice duct 12 in accordance with a manipulation of a user. As shown in FIG. 4, the ice duct opening and closing device 13 may include a funnel 51 which may be fastened to a freezer door 4 by a fastening member, such as a screw or similar device.

The funnel 51 may rotatably support a rotating shaft 70 and a lever 62 of an opening and closing mechanism 60 as described herein below. Further, the funnel 51 may prevent ice passing through the ice duct 12 from bouncing in a forward or side direction in the dispenser. Under the ice duct 12, a duct portion 52 is formed so as to be connected to the lower portion of the ice duct 12.

The funnel 51 may have a micro switch 90 installed on the funnel 51, the micro switch 90 being switched by the lever 62 of the opening and closing mechanism 60. Further, the micro switch 90 may be installed near the duct portion 52.

The ice duct opening and closing device 13 may include a duct cap 58, the opening and closing mechanism 60, and a damper 100. The duct cap 58 may serve to actually open and close the ice duct 12 and may be slidably and rotatably disposed under the ice duct 12.

The duct cap 58 may be rotatably disposed so as to open and close the ice duct 12 in a rotational manner. The duct cap 58 may be disposed to rotate back and forth with reference to the upper portion to a position in which it is inserted into the duct portion 52 of the funnel 51 to make the duct portion 52 of the funnel 51 communicate with the ice duct 12 or to a position in which it is disposed between the duct portion 52 of the funnel 51 and the ice duct 12 so as to block the ice duct 12.

The opening and closing mechanism 60 may serve to allow the duct cap 58 to be manually opened and closed. The opening and closing mechanism 60 may include a lever 62 configured to be manipulated by a user, a rotating shaft 70 which may be mechanically connected to the lever 62 so as to rotate the duct cap 58, and a spring 80 which may elastically support at least one of the lever 62 and the rotating shaft 70 such that the duct cap 58 is automatically rotated to an ice duct closing position, as shown in FIGS. 4 and 5.

The lever 62 may include a vertical bar 63 which may be positioned in an inner space of the dispenser so as to be pressed backward by a user, left and right horizontal bars 64 and 65 which may be bent left and right from both sides from the upper end of the vertical bar 63 and which are rotatably supported by lever supporting portions 53 and 54 formed at the left and right of the rear end of the duct portion 52, respectively, a switch connection bar 66 which may be bent from one of the left and right horizontal bars 64 and 65 so as to turn on/off the micro switch 90, and a shaft connection bar 67 which may be bent from the other of the left and right horizontal bars 64 and 65 so as to be connected to the shaft 70.

The rotating shaft 70 may extend in the left to right direction on an upper portion of the duct portion 52 of the funnel 51. One end of the rotating shaft 70 may have a connection portion 72 projecting on the rotating shaft 70, the connection portion 72 being rotatably connected to a connecting member 71 through the shaft connection bar 67.

One side of the spring 80 may be connected to the funnel 51, and the other side of the spring 80 may be connected to the rotating shaft 70. The spring 80 may be, for example, a coil spring or a torsion spring.

The damper 100 may be a time relay mechanism which delays a closing operation of the duct cap 58. In this embodiment, the damper 100 is an air damper-type time relay mechanism which delays a closing operation of the lever 62, the rotating shaft 70, and the duct cap 58 by using damping force due to air and frictional force. Other types of time relay mechanism may also be appropriate.

The damper 100 may be formed so as not to hinder the rotation of the lever 62 and the rotating shaft 70 such that the duct cap 58 can be quickly opened. When the duct cap 58 is closed, the duct cap 58 may be continuously and slowly closed by the damper 100. Further, the duct cap 58 may be closed slowly for a predetermined period of time and may be then closed quickly by the damper 100.

The damper 100 may include a cylinder 102, a packing 110, a packing holder 120, and a connecting rod 130. The cylinder 102 may be fixed to a support 103 installed in the refrigerator, more specifically, the funnel 51. The support 103 may have a mounting hole **103*a* formed to mount the cylinder 102, and the cylinder 102 may have a mounting portion 102*a*, which may be mounted in the mounting hole 103*a* of the support 103**.

The cylinder 102 may have a plurality of inner-diameter sections or regions 104 and 105, the diameters of which may be different from each other. In the embodiments of FIGS. 4-9, the cylinder 102 has only two inner-diameter regions 104 and 105 formed in two stages. That is, the cylinder 102 only includes a region 104 (hereinafter, referred to as the 'small-diameter region') in which portion the packing 110 is slowly withdrawn or comes out, and a region 105 (hereinafter, referred to as the 'large-diameter region'), in which the packing 110 is quickly withdrawn. Alternately, the cylinder 102 may have three regions including a region in which the packing 110 is slowly withdrawn or comes out, a region in which the packing 110 is withdrawn at an intermediate speed, and a region in which the packing 110 is quickly withdrawn.

The small-diameter region 104 may be formed so as to come into frictional contact with the packing 110, and the large-diameter region 104 may be formed so as not to come into frictional contact with the packing 110. In other words, the inner diameter of the small-diameter region 104 is equal to or smaller than a greatest outer diameter of the packing 110, and the inner diameter of the large-diameter region 105 is larger than the greatest outer diameter of the packing 110.

One end of the cylinder 102, which is closest to the small-diameter region 104 may be closed. The other end of the cylinder 102, which is closest to the large-diameter portion 105, may be open.

The cylinder 102 may have an inclined portion 106 formed between the large-diameter region 105 and the small-diameter region 104, such that the packing 110 positioned inside the large-diameter region 105 easily advances into the small-diameter region 104. In this case, as a length of the small-diameter region 104 increases, the small-diameter region 104 and the packing 110 come into frictional contact with each other for a longer time, thereby increasing a closing delay time of the duct cap 58.

The friction between the packing 110 and the cylinder 102 when the packing 110 is moved within the small-diameter region 104 in one direction may be a different from that when the packing is moved within the small-diameter region 104 in the other direction. The packing 110 may be formed of a flexible material, such as rubber or a similar material, such that the packing 110 is easily contracted or widened/extended.

The packing 110 may have an inclined portion 112 formed on the outer periphery thereof. The outer diameter of the inclined portion 112 may be gradually reduced toward the closed end of the cylinder 102. Therefore, when the packing 110 advances toward the closed end of the cylinder 102, the friction within the small-diameter region 104 is low. When the packing 110 retreats toward the open end of the cylinder 102, the friction with the small-diameter region 104 is high. In other words, when the packing 110 advances toward the closed end of the cylinder 102, the inclined portion 112 is not deformed or is slightly contracted by the small-diameter region 104. Therefore, the friction therebetween is low. However, when the packing 110 retreats toward the open end of the cylinder 102, the inclined portion 112 is widened in an outer-radial direction by the small-diameter region 104. Therefore, the friction therebetween increases.

The packing 110 may be installed in the packing holder 120. The packing holder 102 may be movably disposed inside the cylinder 102. The connecting rod 130 may be connected to the packing holder 120 and one of the duct cap 58 and the opening and closing mechanism 60, such that the packing holder 120 is moved when the lever 62 is manipulated.

One end connection portion 131 of the connecting rod 130 may be connected to any one of the lever 62 and the rotating shaft 70 through a separate connecting member and may be connected to one connecting member 71 connecting the rotating shaft 70 and the lever 62 such that the lever 62, the rotating shaft 70, and the connecting rod 130 are connected together through one connecting member 70. Further, the one end connection portion 131 may be connected to the connecting member 71 connecting the rotating shaft 70 and the lever 62, in order to reduce the number of parts.

Figure 8:
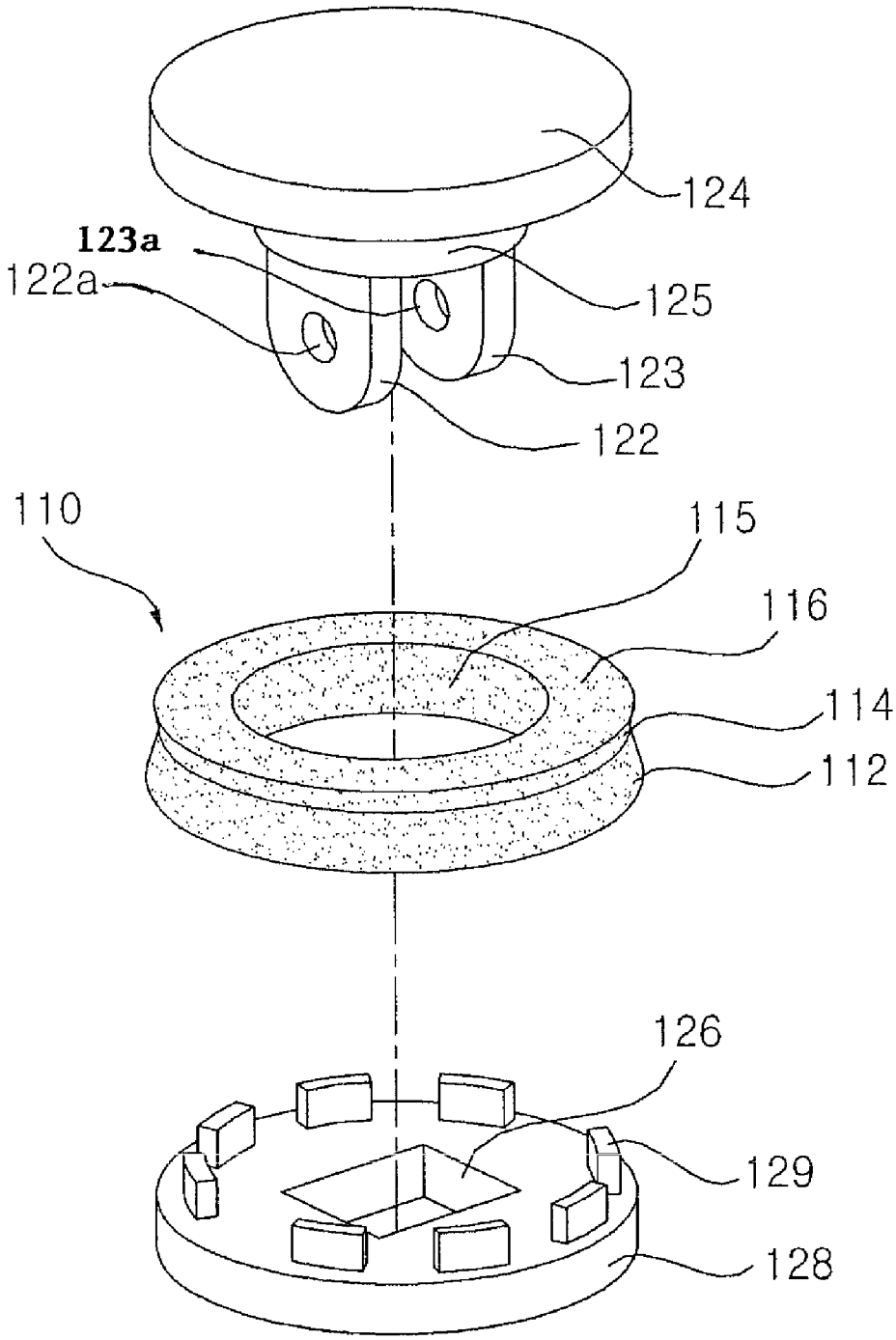
FIG. 8 is an exploded perspective view of a damper shown in FIGS. 4 to 7.
Figure 9:
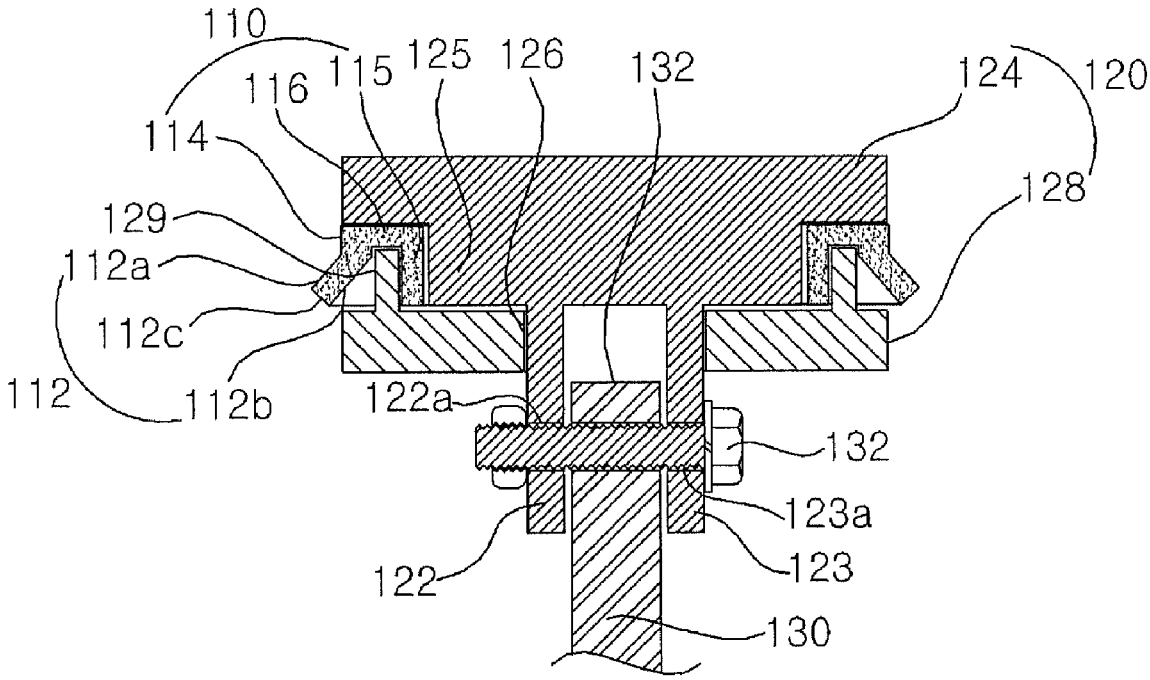
FIG. 9 is an enlarged sectional view of a packing and a packing holder shown in FIG. 8.

FIG. 8 is an exploded perspective view of the damper shown in FIGS. 4 and 7. FIG. 9 is an extended sectional view of the packing and the packing holder shown in FIG. 8.

The packing 110 may be formed to have a ring shape, as shown in FIG. 8. The packing 110 may include an outer circumference 114 having the inclined portion 112 projected therefrom, an inner circumference 115 having a smaller diameter than the outer circumference 114, and a front surface 116 that connects the outer circumference 114 to the inner circumference 115.

As shown in FIG. 9, the inclined portion 112 may include outer and inner surfaces 112*a* and 112*b*, which may be inclined toward the inner surface of the cylinder 102. Further, the packing 110 may have a vertical surface 112*c* formed at a rear end of the inclined portion 112, the vertical surface 112*c* facing the open end of the cylinder 102.

When the packing 110 is moved toward the closed end of the cylinder 102, the outer surface 112*a* of the inclined portion 112 rubs against or comes into frictional contact with the inner surface of the small-diameter region 104. At this time, the inclined portion 112 is not deformed or is slightly contracted in an inner-radial direction, such that the packing 110 is quickly inserted into the small-diameter region 104 without great resistance.

On the other hand, when the packing 110 is moved toward the open end of the cylinder 102, the vertical surface 112*c* and/or the inner surface 112*b* of the inclined portion 112 rubs against or comes into frictional contact with the inner surface of the small-diameter region 104. At this time, the inclined portion 112 is widened in an outer-radial direction. In this case, since the friction between the packing 110 and the small-diameter region 104 is high, the packing 110 is slowly drawn out of the small-diameter region 104.

As shown in FIG. 8, the packing holder 120 may include an inner holder 124 having connection portions 122 and 123 that extend therefrom and an outer holder 128 having a through-hole 126 through which the connection portions 122 and 123 may pass. The connecting rod 130 may be connected to the connection portions 122 and 123, and the packing 110 may be disposed between the inner holder 122 and the outer holder 123.

The inner holder 124 may include an insertion portion 125 configured to be inserted into the space formed by the inner circumference 115 of the packing 110. The connection portions 122 and 123 may be projected from the insertion portion 125 and spaced left and right. The connection portions 122 and 123 may have connection holes 122*a* and 123*a* formed to face each other, such that the other end connection portion of the connecting rod 130 may be connected to the connecting member 132.

A plurality of insertion ribs 129 may be formed on the outer holder 128 along a circumferential direction. The insertion ribs 129 may be configured to be inserted into the ring-shaped space of the packing 110. The plurality of insertion ribs 129 may be closely spaced between the inner circumference 115 and the outer circumference 114 of the packing 110.

The connection portions 122 and 123 of the inner holder 124 may be inserted into the through-hole 126, such that the outer holder 128 is coupled to the inner holder 124. Therefore, the through-hole 126 may be formed to have a slightly larger size than the overall size of the connections portions 122 and 123.

The operation of embodiments having such a structure will be described as follows.

First, when a user presses the vertical bar 63 of the lever 62, the horizontal bars 64 and 65, which are supported by the lever supporting portions 53 and 54 of the funnel 51, are rotated. The shaft connection bar 67 rotates the rotating shaft 70.

The rotating shaft 70 elastically deforms the spring 80 and simultaneously rotates the duct cap 58 to the inner space of the duct portion 52 of the funnel 51. Then, the duct cap 58 opens the ice duct 12.

When the rotating shaft 70 is rotated by the shaft connection bar 67 and the duct cap 58 is opened, the connecting rod 130 is advanced toward the inside of the cylinder 102 together with the packing holder 120 and the packing 110, as shown in FIGS. 5 and 6.

At this time, the packing 110 is quickly inserted toward the small-diameter region 104 without much interference within the large-diameter region 105 of the cylinder 102. Further, the packing 110 is easily inserted into the small-diameter region 104 as the inclined portion 112 slides along the inner surface of the cylinder 102 into the small-diameter region 104.

In other words, the outermost end portion of the inclined portion 112 of the packing 110 is slightly bent in a contraction direction or the outer surface 112*a* of the inclined portion 112 comes into sliding contact with the inner surface of the small-diameter region 104 such that the packing 110 is easily inserted into the small-diameter region 104. At this time, the air inside the small-diameter region 104 quickly escapes to the outside of the small-diameter region 104 through the gap between the inclined portion 112 and the inner surface of the small-diameter region 104, because the friction between the inclined portion 112 of the packing 110 and the small-diameter region 104 is low. The lever 62 and the rotating shaft 70 are rotated without being interfered with by the damper 100, and the duct cap 58 quickly opens the ice duct 12.

When the lever 62 is rotated, the switch connection bar 66 of the lever 62 turns on the micro switch 90, and a controller 30 receives a signal from the micro switch 90 so as to operate a motor 10 of an ice bank 9.

When the motor 10 of the ice bank 9 is operated, ice stored in the ice bank 9 is discharged from the ice bank 9 and falls into the ice duct 12. The ice passes through the open ice duct 12 and the duct portion 52 of the funnel 51 to be discharged into the dispenser.

After that, when a user releases the lever 62, that is, when a user removes the force applied to the lever, the spring 80 is restored to its original state. Simultaneously, the rotating shaft 70 is rotated in a direction of closing the ice duct 12, and the lever 62 is interlocked with the rotating shaft 70 so as to be rotated in a direction of closing the ice duct 12.

When the rotating shaft 70 and the lever 62 are reversely rotated, the switch connection bar 66 of the lever 62 turns off the micro switch 90, and the controller 30 stops the motor 10 of the ice bank 9. Then, the ice is no longer discharged from the ice bank 9.

Further, when the rotating shaft 70 and the lever 62 are reversely rotated, the connecting rod 130 is retreated from the small-diameter region 104 together with the packing holder 120 and the packing 110, as shown in FIG. 7. At this time, while the inclined portion 112 of the packing 110 is extended in the outer-radial direction, the vertical surface 112*c* or the inner surface 112*b* of the inclined portion 112 comes into frictional contact with the small-diameter region 104. In this case, since the friction between the packing 110 and the small-diameter region 104 increases, the packing 110 and the packing holder 120 slowly move due to the damping caused by the frictional force. When the damping caused by the friction force acts as described above, the air inside the large-diameter region 105 does not escape quickly to the inside of the large-diameter region 105 through the gap between the inclined portion 112 of the packing 110 and the inner surface of the small-diameter region 104, because the friction between the inclined portion 112 of the packing 110 and the small-diameter region 104 is high. Further, the air inside the small-diameter region 104 expands, and the packing 110 and the packing holder 120 are slowly moved because of the damping caused by the air.

In other words, the packing 110 is slowly drawn out of the small-diameter region 104 because of the damping action caused by the frictional force and the air. Accordingly, the packing holder 120 and the connecting rod 130 are slowly withdrawn. Further, the lever 62 and the rotating shaft 70 are slowly rotated due to the fine balance between the damping force and the restoring force of the spring 80, and the duct cap 58 slowly closes the ice duct 12. While the closing of the ice duct 12 is delayed, the remaining ice discharged from the ice bank 9 falls into the dispenser.

After a certain period of time has passed, the packing 110 is completely withdrawn out of the small-diameter region 104 and is positioned inside the large-diameter region 105, as shown in FIG. 5. Then, the frictional force does not act on the packing 110, and the packing 110 is quickly moved into the large-diameter region 105 by the restoring force of the spring 80. When the packing 110 is quickly moved, the lever 62 and the rotating shaft 70 are rotated more quickly than when the packing 110 is withdrawn inside the small-diameter region 104, and the duct cap 58 quickly closes the ice duct 12.

Embodiments are not limited to the above-described structure. For example, the ice maker 8 or the ice bank 9 may be installed in the refrigerating compartment door 4. Further, various changes and modifications in form and detail may be made therein without departing from the scope of the present application.

A refrigerator and duct cap assembly therefor according to the embodiment disclosed herein have at least the following advantages.

A refrigerator and duct cap assembly therefor according to the embodiment include the damper which is connected so as to manually open and close the duct cap and is interlocked to the opening and closing mechanism so as to delay the closing operation of duct cap, the closing operation being performed by the opening and closing mechanism. Therefore, it is possible to reduce a cost and minimize noise and/or vibration, compared with when electric driving elements such as solenoids are provided.

The damper may be an air damper-type time relay mechanism including the cylinder, the packing holder, the packing, and the connecting rod. Therefore, the structure of the damper is simple.

The cylinder may include the plurality of small-diameter regions of which the diameters are different from each other. Therefore, the damping force may be a multi-stage device.

The packing may be formed of a rubber material such that noise can be minimized. Further, the packing may have the inclined portion of which the diameter is reduced as the packing approaches the one end of the cylinder. Then, when the packing is advanced toward the one end of the cylinder, the friction with the small-diameter region is low. When the packing is withdrawn toward the other end of the cylinder, the friction with the small-diameter region is high. Accordingly, the duct cap may be easily opened by means of the inclined portion, and the closing of the duct cap may be delayed by the simple structure.

The packing holder may include the inner holder having the connection portions projected therefrom, the connection portions being connected to the connecting rod, and the outer holder having the packing disposed between the inner holder and the outer holder and the through-hole through which the connection portions may pass. Therefore, the packing may be easily and reliably fixed, compared with when the packing is forcibly inserted onto the outer circumferential surface of an integrated holder. Further, it is easy to replace the packing with another packing.

The opening and closing mechanism may include the lever, the rotating shaft connected to the lever so as to rotate the duct cap, and the spring elastically supporting at least one of the lever and the rotating shaft such that the duct cap is rotated to the ice duct closing position. Since the lever and the rotating shaft are directly connected, the structure of the damper is simple, and the number of parts is The connecting rod may be connected to both of the rotating shaft and the lever by one connection member. Therefore, it is possible to minimize the number of connecting members.

Embodiments disclosed herein provide a refrigerator that manually performs an ice discharge operation and uses a damper interlocked with an opening and closing mechanism to delay the closing of a duct cap, making it possible to reduce cost and minimize noise.

According to one embodiment, a refrigerator is provided that include a duct cap disposed so as to open and close an ice duct formed in the refrigerator, an opening and closing mechanism connected so as to open and close the duct cap, and a damper connected to one of the duct cap and the opening and closing mechanism such that a closing operation of the duct cap is delayed, the closing operation being performed by the opening and closing mechanism. The damper may include a cylinder, a packing holder disposed to be movable inside the cylinder, a packing installed in the packing holder, the friction when the packing is moved in one direction and in other direction inside the cylinder being different from each other, and a connecting rod connected to the packing holder and one of the duct cap and the opening and closing mechanism.

The cylinder may include a plurality of inner-diameter portions, the diameters of which are different from each other. Further, the cylinder may have an inclined portion formed between the plurality of inner-diameter portions.

The plurality of inner-diameter portions may be a small-diameter portion which comes into frictional contact with the packing and a large-diameter portion which does not come into frictional contact with the packing. One end of the cylinder which is close to the small-diameter portion may be closed, and the other end which is close to the large-diameter portion may be opened.

The packing may have an inclined portion, of which the diameter is reduced as the packing approaches the one end of the cylinder, such that when the packing is advanced toward the one end of the cylinder, the friction with the small-diameter portion is low, and when the packing is retreated toward the other end of the cylinder, the friction with the small-diameter portion is high. The packing holder may include an inner holder having connection portions formed to be projected, the connection portions being connected to the connecting rod, and an outer holder having the packing disposed between the inner holder and the outer holder and a through-hole through which the connection portions are passed.

The packing may include an outer circumferential portion having an inclined portion formed on the packing, an inner circumferential portion having a smaller diameter than the outer circumferential portion, and a front surface connecting the leading ends of the outer and inner circumferential portions, wherein a ring-shaped space is formed between the outer and inner circumferential portions. The outer holder may have at least one insertion rib which is inserted into the ring-shaped space so as to be inserted into the packing. The packing may be formed of a rubber material.

The opening and closing mechanism may include a lever, a rotating shaft connected to the lever so as to rotate the duct cap, and a spring elastically supporting at least one of the lever and the rotating shaft such that the duct cap is rotated to an ice duct closing position. The lever may include a shaft connection bar which is rotatably connected to the rotating shaft and a connecting member. The connecting rod may be connected to both of the rotating shaft and the shaft connection bar by the connecting member. The cylinder may be fixed to a support installed in the refrigerator.

The refrigerator may further include a funnel having a duct portion formed to communicate with a lower portion of the ice duct and rotatably supporting the rotating shaft and the lever. The funnel may include the support.

According to another embodiment, a refrigerator is provided that include a funnel disposed to communicate with an ice duct formed in the refrigerator, a duct cap opening and closing the ice duct, a rotating shaft connected to the duct cap so as to rotate the duct cap, the rotating shaft being rotatably supported by the funnel, a lever connected to the rotating shaft so as to rotate rotating shaft, the lever being rotatably supported by the funnel, a spring elastically supporting at least one of the lever and the duct cap such that the duct cap is rotated to an ice duct closing position, a cylinder installed in the funnel, a packing holder disposed to be movable inside the cylinder, a packing installed in the packing holder, and a connecting rod connected to the packing holder and one of the duct cap and the opening and closing mechanism. The packing may have an inclined portion, the outer diameter of which is reduced as the packing approaches one end of the cylinder, such that when the packing is advanced toward the one end of the cylinder, the friction with the cylinder is low, and when the packing is retreated toward the other end of the cylinder, the friction with the cylinder is high. The cylinder may have a small-diameter portion which comes in frictional contact with the packing and a large-diameter portion which does not come in frictional contact with the packing.

According to a further embodiment, a refrigerator is provided that include a duct cap disposed so as to open and close an ice duct formed in the refrigerator, a rotating shaft rotating the duct cap, a lever connected to the rotating shaft so as to rotate the rotating shaft, a spring elastically supporting at least one of the lever and the rotating shaft such that the duct cap is rotated to an ice duct closing position, a cylinder installed in the refrigerator and having a small-diameter portion and a large-diameter portion formed therein, the one end of the cylinder being closed and the other end being open, a packing holder disposed to be movable inside the cylinder, a packing installed in the packing holder and having a smaller diameter than the large-diameter portion, the friction when the packing is moved in one direction and in the other direction inside the small-diameter portion being different from each other, and a connecting rod connected to the packing holder and at least one of the lever and the rotating shaft. The lever may have a shaft connection bar connected to the rotating shaft and the connecting rod through one connecting member.

In the refrigerator having such a construction, the damper is provided to manually open and close the duct cap, the damper being interlocked with the opening and closing mechanism so as to delay the closing operation of the duct cap. Therefore, it is possible to reduce a cost and minimize noise and/or vibration, compared with when electric driving parts, such as solenoids, are provided.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although several embodiments have been described, it should be understood that numerous other modifications and embodiments can be devised by those skilled in the art that will fall within the spirit and scope of the principles of this disclosure. More particularly, various variations and modifications are possible in the component parts and/or arrangements of the subject combinations and still fall within the scope of the disclosure, the drawings and the appended claims. In addition to variations and modifications in the component parts and/or arrangements, alternative uses will also be apparent to those skilled in the art.

What is claimed is:

1. A duct cap assembly for a refrigerator, comprising:

a duct cap configured to open and close an ice duct formed in the refrigerator;

an opening and closing mechanism configured to open and close the duct cap; and a damper assembly connected to one of the duct cap or the opening and closing mechanism so as to delay a closing operation of the duct cap upon initiation of a closing operation, wherein the damper assembly comprises:

a cylinder having a plurality of inner-diameter regions, each inner-diameter region having a different diameter;

a packing holder movably installed within the cylinder, the packing holder comprising an inner holder and an outer holder;

a connecting rod having a first end connected to the outer holder and a second end that is connected to the one of the duct cap or the opening and closing mechanism; and packing positioned between the inner and outer holders of the packing holder such that a first side of the packing facing the open end of the cylinder is positioned against the outer holder and a second side of the packing facing a closed end of the cylinder is positioned against the inner holder, wherein the outer holder comprises at least one insertion rib configured to be inserted into an annular recess formed in the first side of the packing so as to fix the packing in position between the inner and outer holders, wherein the packing comprises:

a first section that extends from the first side thereof to an intermediate portion of the packing; and a second section that extends from the intermediate portion of the packing to the second side thereof, wherein the first section has a substantially constant diameter that is substantially equal to that of the first holder, and the second section has an inclined outer circumference such that a diameter thereof is greater than that of the second holder and extends outside of an outer circumference of the packing holder.

2. The duct cap assembly of claim 1, wherein friction generated when the packing is moved in a first direction is different than friction generated when the packing is moved in a second direction within the cylinder that is opposite the first direction.

3. The duct cap assembly of claim 1, wherein the cylinder further comprises an inclined portion formed between the plurality of inner-diameter regions.

4. The duct cap assembly of claim 1, wherein the plurality of inner-diameter regions comprises a small-diameter region, an inner surface of which comes into frictional contact with the packing, and a large-diameter region, an inner surface of which does not come into frictional contact with the packing.

5. The duct cap assembly of claim 4, wherein the small-diameter region is close to the closed end of the cylinder, and the large-diameter region is close to the open end of the cylinder.

6. The duct cap assembly of claim 5, wherein the packing comprises:

a first section that extends from the first side thereof to an intermediate portion of the packing; and a second section that extends from the intermediate portion of the packing to the second side thereof, wherein the first section has a substantially constant diameter that is substantially equal to that of the first holder, and the second section has an inclined outer circumference such that a diameter thereof is greater than that of the second holder and extends outside of an outer circumference of the packing holder, wherein the diameter of the second section is reduced as the packing approaches the closed end of the cylinder, such that when the packing is advanced toward the closed end of the cylinder, the friction with the small-diameter region is low, and when the packing is withdrawn toward the open end of the cylinder, the friction with the small-diameter region is high.

7. The duct cap assembly of claim 1, wherein the inner holder comprises connection portions that project therefrom, so as to be connected to the connecting rod, and the outer holder comprises a through-hole that receives the connection portions therethrough.

8. The duct cap assembly of claim 7, wherein the packing further comprises an annular recess formed in the first side thereof, between an outer circumference and an inner circumference thereof.

9. The duct cap assembly of claim 8, wherein the outer holder has at least one insertion rib configured to be inserted into the annular recess formed in the first side of the packing.

10. The duct cap assembly of claim 1, wherein the packing is formed of a rubber material.

11. The duct cap assembly of claim 1, wherein the opening and closing mechanism comprises:

a lever;

a rotating shaft connected to the lever so as to rotate the duct cap; and a spring elastically supporting at least one of the lever or the rotating shaft such that the duct cap is rotated to an ice duct closing position by the spring.

12. The duct cap assembly of claim 11, wherein the lever includes a shaft connection bar which is rotatably connected to the rotating shaft and a connecting member.

13. The duct cap assembly of claim 12, wherein the connecting rod is connected to both of the rotating shaft and the shaft connection bar by the connecting member.

14. The duct cap assembly of claim 11, wherein the cylinder is fixed to a support configured to be installed in the refrigerator.

15. The duct cap assembly of claim 14, further comprising:

a funnel having a duct portion configured to communicate with a lower portion of the ice duct and rotatably supporting the rotating shaft and the lever, the funnel including the support.

16. A refrigerator comprising the duct cap assembly of claim 1.

17. A duct cap assembly for a refrigerator, comprising:

a funnel configured to communicate with an ice duct formed in the refrigerator;

a duct cap configured to open and close the ice duct;

an opening and closing mechanism configured to open and close the duct cap; and a damper assembly connected to one of the duct cap or the opening and closing mechanism so as to delay a closing operation of the duct cap upon initiation of a closing operation, wherein the damper assembly comprises:

a cylinder having a plurality of different inner-diameter regions;

a packing holder movably installed within the cylinder, the packing holder comprising an inner holder and an outer holder; and packing positioned between the inner and outer holders of the packing holder, wherein the outer holder comprises at least one insertion rib configured to be inserted into an annular recess formed in the first side of the packing so as to fix the packing in position between the inner and outer holders.

18. The duct cap assembly of claim 17, wherein the opening and closing mechanism comprises:

a rotating shaft connected to the duct cap so as to rotate the duct cap, the rotating shaft being rotatably supported by the funnel;

a lever connected to the rotating shaft so as to rotate rotating shaft, the lever being rotatably supported by the funnel; and a spring elastically supporting at least one of the lever and the duct cap such that the duct cap is rotated to an ice duct closing position by the spring.

19. The duct cap assembly of claim 17, wherein the cylinder is installed in the funnel, and wherein the damper assembly further comprises a connecting rod connected to the packing holder and the one of the duct cap or the opening and closing mechanism.

20. The duct cap assembly of claim 19, wherein the packing has an inclined portion, wherein an outer diameter is reduced as the packing approaches one end of the cylinder such that when the packing is advanced toward the one end of the cylinder, friction with the cylinder is low, and when the packing is withdrawn toward the other end of the cylinder, friction with the cylinder is high.

21. The duct cap assembly of claim 20, wherein the plurality of different inner-diameter regions of the cylinder comprise a small-diameter region, an inner surface of which comes into frictional contact with the packing and a large-diameter region, an inner surface of which does not come in frictional contact with the packing.

22. The duct cap assembly of claim 21, wherein friction generated when the packing is moved in one direction within the small-diameter region is different from friction created when the packing is moved in an opposite direction within the small-diameter region.

23. A refrigerator comprising the duct cap assembly of claim 17.

24. The duct cap assembly of claim 17, wherein an outer diameter of the packing is variable such that at least a portion of an outer circumferential edge of the packing extends out beyond an outer circumferential edge of the packing holder so as to contact a corresponding portion of an inner circumferential surface of the cylinder.

* * * * *